US011555650B2

(12) United States Patent
Gerstmayr et al.

(10) Patent No.: US 11,555,650 B2
(45) Date of Patent: Jan. 17, 2023

(54) HOUSEHOLD REFRIGERATION APPLIANCE WITH A DISPLAY AND/OR CONTROL UNIT

(71) Applicant: BSH HAUSGERAETE GMBH, Munich (DE)

(72) Inventors: Florian Gerstmayr, Gundelfingen (DE); Simon Kraemer, Aalen (DE); Oliver Elser, Koenigsbronn (DE)

(73) Assignee: BSH Hausgeraete GmbH, Munich (DE)

( * ) Notice: Subject to any disclaimer, the term of this patent is extended or adjusted under 35 U.S.C. 154(b) by 300 days.

(21) Appl. No.: 16/811,592

(22) Filed: Mar. 6, 2020

(65) Prior Publication Data

US 2020/0284503 A1 Sep. 10, 2020

(30) Foreign Application Priority Data

Mar. 7, 2019 (DE) ..... 102019203114

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 2400/36* (2013.01); *F25D 2400/361* (2013.01)

(58) Field of Classification Search
CPC .. F25D 23/028; F25D 29/005; F25D 2400/36; F25D 2400/361
See application file for complete search history.

(56) References Cited

U.S. PATENT DOCUMENTS

| | | | | |
|---|---|---|---|---|
| 4,092,698 | A | 5/1978 | Brefka | |
| 9,958,898 | B1 * | 5/2018 | Shaw | G06F 1/1601 |
| 10,480,847 | B2 | 11/2019 | Heisswolf et al. | |
| 2008/0297019 | A1 * | 12/2008 | Kim | F25D 23/02 312/405 |
| 2011/0006655 | A1 | 1/2011 | Seo et al. | |
| 2015/0323243 | A1 * | 11/2015 | Han | F25D 23/028 312/405 |
| 2017/0370636 | A1 * | 12/2017 | Koo | F25D 23/02 |

FOREIGN PATENT DOCUMENTS

| | | | |
|---|---|---|---|
| CN | 103814263 | A | 5/2014 |
| CN | 205606979 | U | 9/2016 |
| CN | 108351157 | A | 7/2018 |
| DE | 102009027891 | A1 | 1/2011 |

* cited by examiner

*Primary Examiner* — Jonathan Bradford
(74) *Attorney, Agent, or Firm* — Laurence A. Greenberg; Werner H. Stemer; Ralph E. Locher

(57) ABSTRACT

A household refrigeration appliance includes a body having a storage compartment disposed therein which is closeable by a terminating element. A display and/or control unit has a cover formed by a plate. A carrier frame is fastened to the rear of the plate and an electronic display and/or control is disposed on the carrier frame.

17 Claims, 3 Drawing Sheets

HOUSEHOLD REFRIGERATION APPLIANCE WITH A DISPLAY AND/OR CONTROL UNIT

CROSS-REFERENCE TO RELATED APPLICATION

This application claims the priority, under 35 U.S.C. § 119, of German Patent Application DE 10 2019 203 114, filed Mar. 7, 2019; the prior application is herewith incorporated by reference in its entirety.

BACKGROUND OF THE INVENTION

Field of the Invention

The invention relates to a household refrigeration appliance including a body or carcass, a storage compartment disposed in the body or carcass, a closure element for closing the storage compartment and a display and/or control unit.

A household refrigeration appliance of that type can, for instance, be a refrigerator, an upright freezer or a refrigerator-freezer.

The display and/or control unit serves for instance to set storage conditions such as temperature or humidity within the storage compartment or to inform a user about the set storage conditions.

BRIEF SUMMARY OF THE INVENTION

It is accordingly an object of the invention to provide a household refrigeration appliance with a display and/or control unit, which improves the generic household refrigeration appliances of this general type.

With the foregoing and other objects in view there is provided, in accordance with the invention, a household refrigeration appliance including a body or carcass, a storage compartment disposed in the body or carcass and closeable by a closure element, and a display and/or control unit. The display and/or control unit has a cover formed by a plate, a carrier frame is fastened to the rear of the plate, and an electronic display and/or control is disposed on the carrier frame.

In this case the cover forms a surface which is facing a user, at least in an opened state of the closure element, or can be examined and/or is accessible by a user. The cover therefore forms an exterior surface of the household refrigeration appliance, at least in an opened state of the closure element.

In accordance with the invention the cover is to be formed by a plate. The plate has a width, a height and a thickness. Both the width and also the height are greater, in particular by a multiple greater, than the thickness.

The phrase "to the rear" is to be understood to mean that the carrier frame is fastened to a rear side of the plate, in other words on the side opposing the exterior surface. In particular, provision can therefore be made for the carrier frame to be covered completely by the plate, i.e. not to be accessible for a user.

The display and/or control unit includes, as separate physical units in each case, the plate, the carrier frame and the electronic display and/or control.

Embodiments of the present invention are explained below.

As seen in a top view onto the cover (in a projection plane parallel to a main extension plane of the plate), the cover formed by the plate can at least partially cover the remaining components of the display and/or control unit. According to one embodiment, provision can be made, however, for the cover to completely cover the remaining components of the display and/or control unit in a projection plane parallel to a main extension plane of the plate. In this way the remaining components of the display and/or control unit can be completely protected by the cover and in particular a penetration of dirt and/or humidity can be avoided.

Provision can be made for the carrier frame to be fastened exclusively to the rear of the plate. Provision can be made for outer edges of the plate to be exposed, in particular not enclosed by the carrier frame.

The thickness of the plate can be between 1 mm and 8 mm or between 2 mm and 6 mm and by way of example the thickness is 4 mm. It is conceivable for the plate to have a constant thickness.

In fact, it is basically possible for the plate to be embodied to be curved, for instance curved about a single axis. According to one embodiment, provision is made, however, for the plate to be embodied to be flat.

According to one embodiment, provision is made for the plate to be at least partially transparent. The phrase "at least partially transparent" is to be understood in this case to mean that the complete plate has an equal degree of transparency (completely transparent or semi-transparent) or that the plate has a first section and a second section, wherein at least the first section has a (semi-) transparency. In this case the second section can be embodied to be opaque. Provision can be made for the plate to have a printing. In particular, provision can be made for the printing to be applied to a rear side of the plate. In this case the rear side refers to that side of the plate which is facing away from a user. It is also conceivable for the plate to have one, in particular uniform, color.

The plate is preferably embodied in one piece, in particular with one material. The plate can be formed of plastic or glass. In particular, the use of glass enables a very reliable coverage of the electronic display and/or control. Scratches on the plate which occur during the use of the household refrigeration appliance and dirt on the plate resulting therefrom can be minimized or prevented by using a plate made from glass.

The carrier frame can have a rectangular outer contour and/or form a closed frame. The carrier frame can have a cutout disposed in particular centrally, and/or substantially centrally. The cutout can accommodate the electronic display and/or control at least partially and/or the electronic display and/or control can project into the cutout at least in sections.

According to one embodiment, provision is made for the carrier frame to have a joining surface for fastening to the plate. The joining surface can be embodied to be flat and/or have the shape of a circumferential, in particular closed, frame (in this case the electronic display and/or control can be disposed completely inside the frame). The joining surface is preferably embodied completely parallel to a rear side of the plate. If the carrier frame has a cutout, the joining surface can enclose the cutout.

According to one embodiment provision is made for the plate to be fastened to the carrier frame exclusively by using a rear side of the plate. Edges of the plate can therefore be exposed, so that the display and/or control unit can be easily inserted into a receptacle substantially without a gap. In particular, with the inventive display and/or control unit, it is possible to dispense with a separate outer frame. In particular, the plate can be constructed to be frameless. As a result, the household refrigeration appliance can be cleaned more easily.

According to one embodiment, provision is made for the carrier frame to be embodied in one piece, in particular with one material. In particular, the carrier frame can be a plastic injection-molded part.

The plate can be detachably connected to the carrier frame in a non-destructive manner. In this regard in particular a snap-on connection, in which the carrier frame engages behind edge sections of the plate, is conceivable. According to one embodiment, provision is made, however, for the plate to be non-detachably connected to the carrier frame in a non-destructive manner. This enables simple disassembly of the display and/or control unit, during disassembly of the display and/or control unit, by avoiding an unintentional detachment of the plate from the carrier frame. For instance, the plate can be connected to the carrier frame by material engagement, in particular by using a particularly sealing adhesive bond. The adhesive bond can be formed by a double-sided adhesive tape and/or by a foamable adhesive. The double-sided adhesive tape or the foamable adhesive is preferably disposed in strips (e.g. one strip, two strips, three strips, four strips or more strips) between the plate and the carrier frame. It is conceivable in particular for the double-sided adhesive tape or the foamable adhesive to form a closed frame. In addition to a mechanically stable connection of the plate with the carrier frame, a closed frame additionally improves the sealing effect. It is therefore possible to counteract the penetration of moisture into the interior of the display and/or control unit.

According to one embodiment, provision is made for the adhesive bond to be formed by a closed-porous adhesive tape. This material once again improves the sealing effect in order to prevent the penetration of moisture.

According to one embodiment, provision is made for the electronic display and/or control to be fastened detachably to the carrier frame in a non-destructive manner or to be disassemblable from the carrier frame in a non-destructive manner. This enables the electronic display and/or control to be easily replaced in the possible event of damage, once the display and/or control unit has been disassembled from the household refrigeration appliance. In particular, according to one embodiment provision can be made for the electronic display and/or control to be connected to the carrier frame by using a form-locking and/or force-locking connection, for instance a snap-on connection. Provision can be made in this case for the form-locking and/or force-locking connection to fix the electronic display and/or control and the carrier frame in a first direction and optionally in a second direction, which is oriented at right angles to the first direction, while the electronic display and/or control and the carrier frame are mounted with play in a third direction which is oriented at right angles to the first direction and second direction. The first direction and the second direction can lie in a main extension plane of the plate, while the third direction can lie at right angles to this main extension plane. In this way in a top view of the plate the electronic display and/or control can on one hand be fixed precisely with respect to its position. In particular, with respect to the first direction and (optionally) the second direction, a substantially play-free fixing can be achieved. On the other hand, the electronic display and/or control can be brought into the desired position along the third direction by using the mounting with play despite possible manufacturing tolerances. If necessary, it is possible for the electronic display and/or control to rest on a rear side of the plate. It is conceivable for the carrier frame to have one, two, three or more snap-on hooks, by using which the snap-on edges are engaged behind the electronic display and/or control, e.g. a housing. The snap-on hooks can be disposed on two opposing sides of a cutout of the carrier frame.

According to one embodiment, provision is made for the electronic display and/or control to be pressed against a rear side of the plate by using at least one spring element. The spring element can be fastened to the display and electronic control in a loss-proof manner, for instance. The spring element can be fastened in particular to a housing of the electronic display and/or control. The spring element can be a helical spring, e.g. made from metal, for instance.

According to one embodiment, provision is made for the electronic display and/or control within the display and/or control unit to be held or fastened exclusively on the carrier frame and/or to be received in the carrier frame, e.g. in a cutout of the carrier frame. In particular, with a disassembled display and/or control unit, the electronic display and/or control can be held on or fastened to the carrier frame in a loss-proof manner.

According to one embodiment, provision is made for the electronic display and/or control to include a housing and/or an electrical terminal.

According to one embodiment, provision is made for the display and/or control unit to be detachably fastened in, at or to the household refrigeration appliance in a non-destructive manner. This enables simple disassembly of the complete display and/or control unit, for instance if the electronic display and/or control is to be replaced. It is conceivable for the display and/or control unit to be attached to the household refrigeration appliance by using a form-locking and/or force-locking connection. Therefore, according to one embodiment, provision is made for the display and/or control unit to be fastened in, at or to the household refrigeration appliance by using a snap-on connection. It is conceivable for the snap-on connection to have first snap-on elements, which are embodied on the carrier frame, and second snap-on elements, which are embodied on a receptacle in which the display and/or control unit is fastened.

According to one embodiment, provision is made for the display and/or control unit, including the plate, the carrier frame and the display and/or control unit, only to be held on or fastened to the household refrigeration appliance by using the carrier frame.

The closure element can be formed by a door, by a flap or by a drawer. According to one embodiment, provision is made for the display and/or control unit to be fastened to a narrow side of the closure element. The narrow side can, for instance, be a lateral narrow side (main extension in the vertical direction) of a door or a horizontal narrow side (main extension in the horizontal direction) of a drawer. The narrow side can be embodied to be flat, in particular horizontal or vertical. According to one embodiment provision is made for the narrow side to be formed substantially completely by using a terminating element. The terminating element can be a door end strip or a drawer end strip, for instance. The terminating element can be connected to an inner boundary wall and to an outer boundary wall of the closure element and/or with these bound a cavity filled with insulation material. Provision can be made for a length of the plate measured along the longitudinal direction of the narrow side (direction of the maximum extension of the narrow side) to be at most 50%, at most 40% or at most 30% of the maximum extension of the narrow side. Provision can be made for a width of the plate measured along the width direction of the narrow side (vertical direction relative to the longitudinal direction) to be more than at least 50%, at least 75% or at least 80% of the width of the narrow side. A very compact construction of the inventive display and/or control unit results in this way, so that negative effects on the thermal insulation of the household refrigeration appliance can be avoided.

The household refrigeration appliance can have a receptacle, in which the display and/or control unit is at least partially disposed. In particular, it is conceivable that the display and/or control unit is disposed substantially completely in the receptacle. The plate can be disposed flush with a surface of the household refrigeration appliance which contains or encloses the receptacle. It is possible for the plate to substantially completely close the receptacle. The receptacle can be formed by a depression or trough. A section of the household refrigeration appliance containing the receptacle can be embodied in one piece and enclose the display and/or control unit in the form of a closed frame. The receptacle can have a wire bushing, for instance in the form of a hole. The wire bushing can be used to guide an electrical wire for connection with the electronic display and/or control into the receptacle. The wire bushing can be disposed on a base of the receptacle and/or be formed by a pipe connection. The pipe connection can extend away from the receptacle in particular when disposed on a boundary wall (e.g. base) of the receptacle. In this way a seal of the wire bushing with respect to emerging insulation material can be improved and an adequately sized receptacle can be provided at the same time. A sealing element can be disposed on the wire bushing in order to prevent thermal insulation material from penetrating the receptacle.

If the display and/or control unit is fastened to a narrow side of the closure element, which is formed substantially completely by a terminating element, provision can be made for the display and/or control unit to be disposed in a receptacle embodied in one piece in the terminating element. In particular, it is conceivable for the terminating element forming the receptacle to be a plastic injection-molded part. Due to the single-piece embodiment of the receptacle in the terminating element, a very simple and compact construction is achieved, as a result of which a good thermal insulation effect of the household refrigeration appliance can be achieved.

According to one embodiment, provision is made for the display and/or control unit to include a sealing element. The sealing element can provide a seal between the display and/or control unit and the household refrigeration appliance, for example the receptacle. According to one embodiment, provision is made for a sealing element to be disposed on or fastened to the carrier frame. The sealing element can be circumferentially closed. The sealing element can be a ring-shaped or frame-shaped sealing element, which rests against or is fastened to a ring-shaped or frame-shaped sealing seat, e.g. collar, of the carrier frame. The sealing element can in particular seal a gap between the carrier frame and a receptacle for the display and/or control unit. The sealing element can be disposed, e.g. rest on a surface of the carrier frame facing away from the plate. The sealing element can be clamped to the carrier frame, for instance the collar, using elastic deformation. In this way simple assembly is possible in conjunction with a precise positioning of the sealing element. In this case the sealing element can be formed of elastomer. The sealing element can also be formed by foamed polyurethane, however. In this case, the sealing element is fastened to the display and/or control unit (e.g. carrier frame) by material engagement.

According to one embodiment, provision is made for a wire flashing to be disposed on the carrier frame. The wire flashing is used to accommodate an overlength of a wire required for contacting the electronic display and/or control. The overlength is advantageous in order to be able to disassemble and assemble the electronic display and/or control easily and without damage. The wire flashing can be embodied in one piece on the carrier frame. The wire flashing can be formed by one, by two or by more holding claws.

A compact assembly results due to the inventive display and/or control unit. Provision is therefore made in accordance with one embodiment, in a projection plane parallel to a main extension plane of the plate (top view onto the plate) for a rectangle enclosing the carrier frame to correspond to at least 75%, at least 80% or at least 90% of the surface of a rectangle enclosing the plate. The external dimensions of the carrier frame are therefore not significantly smaller than the dimensions of the plate. In this way it is possible to achieve a good support of the plate by the carrier frame with a simultaneously high sealing effect. Furthermore, sufficient space can be enabled in the carrier frame in order to receive the electronic display and/or control.

According to one embodiment, provision is made, in a projection plane parallel to a main extension plane of the plate, for a rectangle enclosing the plate to correspond substantially to a rectangle which encloses a receptacle for the display and/or control unit in this projection plane.

According to one embodiment, provision is made, in a projection plane parallel to a main extension plane of the plate, for a rectangle enclosing the electronic display and/or control to correspond to at least 40%, at least 50% or at least 60% of the surface of a rectangle enclosing the plate.

The household refrigeration appliance can be a refrigerator, an upright freezer or a refrigerator-freezer.

It is conceivable for a second, a third or a plurality of display and/or control units according to the invention to be disposed on the household refrigeration appliance.

The stipulations "above," "below," "in front," "behind," "horizontal," "depth direction," "width direction," "height direction," etc., indicate positions and orientations during proper use and configuration of the household refrigeration appliance and with an observer positioned in front of, and looking in the direction of, the household refrigeration appliance.

Other features which are considered as characteristic for the invention are set forth in the appended claims.

Although the invention is illustrated and described herein as embodied in a household refrigeration appliance with a display and/or control unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
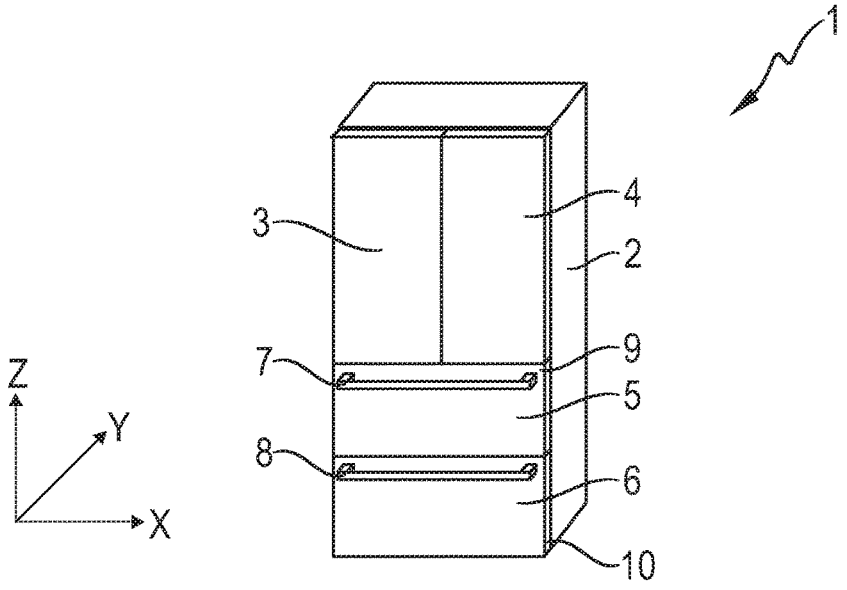
FIG. 1 is a diagrammatic, perspective view of a household refrigeration appliance according to the present invention.

Referring now to the figures of the drawings in detail and first, particularly, to FIG. 1 thereof, there is seen a household refrigeration appliance 1, which is embodied to store and conserve food. In the exemplary embodiment the household refrigeration appliance 1 is a refrigerator-freezer. The household refrigeration appliance 1 has a body 2, in which a plurality of separate storage compartments (not shown) for food to be cooled or frozen are formed. An upper storage compartment can be closed or accessed by using two closure elements 3, 4 in the form of doors disposed adjacent one another. Two further storage compartments are disposed below the upper storage compartment and can be closed or accessed by using closure elements 5, 6, in the form of drawers. The two drawers have external handles 7, 8. Each of the drawers includes a drawer front 9, 10 which is coupled in each case with a pull-out mechanism, not shown.

Figure 2:
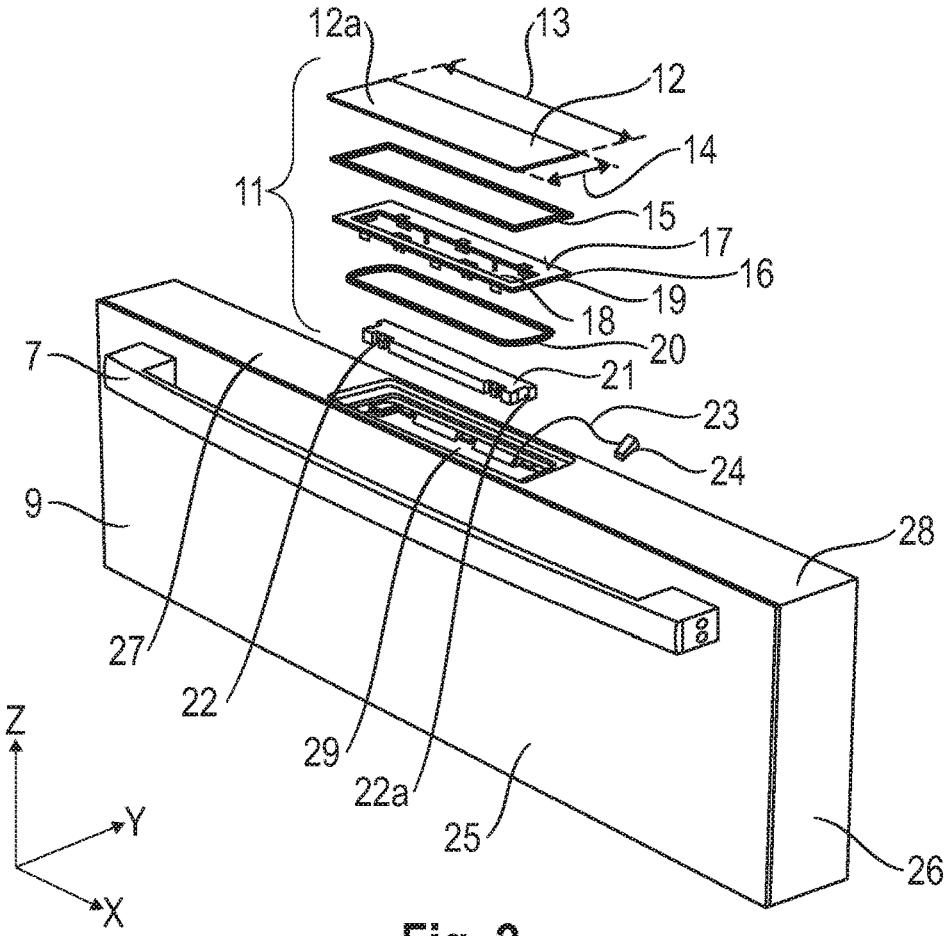
FIG. 2 is an exploded, perspective view of a drawer front with the display and/or control unit.

FIG. 2 shows the drawer front 9 of the upper drawer 5. A display and/or control unit 11 according to the present invention is fastened to the drawer front 9 and thus to the drawer 5. For illustration purposes, FIG. 2 shows the display and/or control unit 11 in a non-assembled state and in an exploded representation.

The display and/or control unit 11 includes a plate 12 which is formed of glass and is embodied to be flat, in particular two-dimensional. The plate 12 is rectangular. In this case a width 13 measured in the width direction X and a depth 14 of the plate 12 measured in the depth direction Y are greater by a multiple than a thickness of the plate 12 measured in the height direction Z. The width 13 is approximately four times as large as the depth 14.

The display and/or control unit 11 further includes an adhesive bond 15 which is formed by a closed-porous, two-sided adhesive tape. The adhesive bond 15 has the shape of a rectangular and a closed frame. A width of the adhesive bond 15 measured in the width direction X corresponds in this case to substantially 90% of the width 13 of the plate 12. A depth of the adhesive bond 15 measured in the depth direction Y corresponds in this case to substantially 90% of the depth 14 of the plate 12.

The display and/or control unit 11 further includes a carrier frame 16. The carrier frame 16 is a plastic injection-molded part and has a circumferential and closed frame 19. The carrier frame 16 has a connection surface 17 facing the plate 12. The connection surface 17 is parallel to the main extension plane of the plate 12. The main extension plane of the plate 12 is formed by a plane lying in the X-Y plane. The connection surface 17 has the shape of a closed frame, which bounds the carrier frame 16. The connection surface 17 is embodied on the frame 19. The carrier frame 16 has a cutout 18. The cutout 18 enables an electronic display and/or control, which is accommodated in the carrier frame 16, to be moved to such an extent that contact is made with the plate 12 in the direction of the plate 12. The carrier frame 16 further includes snap-on elements, on one hand for connection with the drawer front 9 and on the other hand for connection with an electronic display and/or control. These snap-on elements are facing away from the plate with respect to the connection surface 17 and project rearward from the frame 19.

The adhesive bond 15 represents a non-detachable connection between the plate 12 and the carrier frame 16 in a non-destructive manner.

The display and/or control unit 11 further includes a sealing element 20, which is formed of foamed polyurethane. The sealing element 20 is formed by a circumferential, closed frame. The sealing element 20 is fastened to the carrier frame 16 by material engagement and in a loss-proof manner.

The display and/or control unit 11 further includes an electronic display and/or control 21. In this exemplary embodiment the electronic display and/or control 21 in turn includes a housing 22 and an electrical terminal 22*a*. The electronic display and/or control 21 can be connected to a connector 24 of an electrical wire 23 by way of the electrical terminal 22*a*. The electrical wire 23 extends from a cavity of the drawer front 9 into a receptacle 29. A display module and a control module are disposed in the housing 22. Through the use of the semi-transparent plate 12, a user standing in front of the household refrigeration appliance 1 can perceive the information shown by the display module and perform inputs by way of the control module when the drawer 5 (or opened doors disposed there-above) is partially opened.

The drawer front 9 includes a front wall 25 and a rear wall (not visible in FIG. 2). The front wall 25 and the rear wall are connected by narrow sides 26, 27 of the drawer front 9 and the cavity bounded thereby is filled with insulation material.

The upper narrow side 27 is formed substantially completely by a terminating element 28. The terminating element 28 extends in the width direction X substantially across the entire width of the drawer front 9 and extends in the depth direction Y substantially across the entire depth of the drawer front 9. The terminating element 28 is a plastic injection-molded part. The terminating element 28 has the receptacle 29 for the display and/or control unit 11. The receptacle 29 is embodied in one piece with the terminating part 28. The receptacle 29 represents a depression or trough in the terminating element 28. A width of the receptacle 29 measured in the width direction X corresponds in this case substantially to the width 13 of the plate 12 and a depth of the receptacle 29 measured in the depth direction Y corresponds in this case substantially to the depth 14 of the plate 12. Snap-on elements are embodied in the receptacle 29, onto which the carrier frame 16 and thus the display and/or control unit 11 can be snapped.

The width 13 of the plate 12 corresponds to less than a third of a width of the drawer front 9 measured in the width direction X. The depth 14 of the plate 12 corresponds to more than 90% of a depth of the drawer front 9 measured in the depth direction Y.

Figure 3:
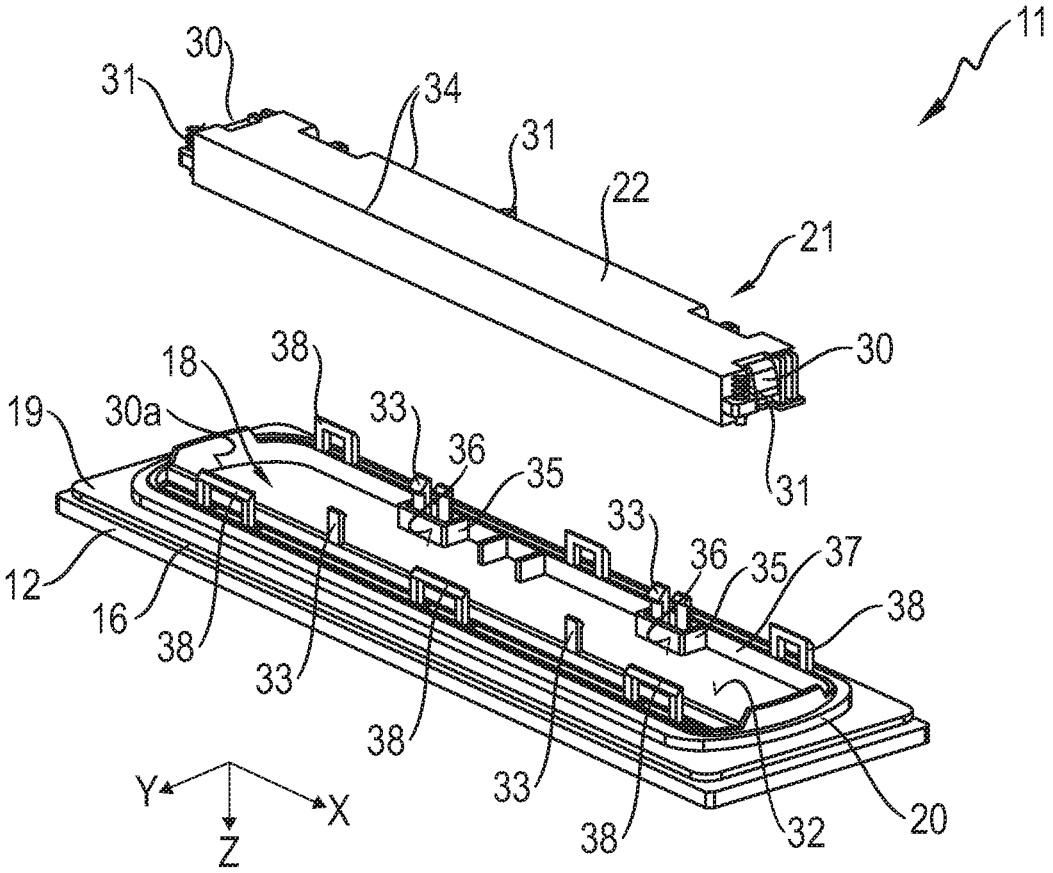
FIG. 3 is an exploded, rear-perspective view of the display and/or control unit with a disassembled electronic display and/or control.

FIG. 3 shows a rear view of the display and/or control unit 11 from FIG. 2 with a disassembled electronic display and/or control 21.

The electronic display and/or control 21 has spring bands 30 on two opposing lateral end sections. The electronic display and/or control 21 can be clamped in the width direction X in the carrier frame 16 by using the spring bands 30. As a result, the position of the electronic display and/or control 21 is defined with respect to the carrier frame 16 in the width direction X. The spring bands 30 are embodied in one piece on the housing 22. The spring bands 30 abut clamping surfaces 30*a* of the carrier frame 16.

Spring elements 31 in the form of helical springs are fastened to the housing 22 in a loss-proof manner. The electronic display and/or control 21 can be supported in the receptacle 29 by using the spring elements 31 and can press against a rear side 32 of the plate 12 through the cutout 18 of the carrier frame 16.

Figure 4:
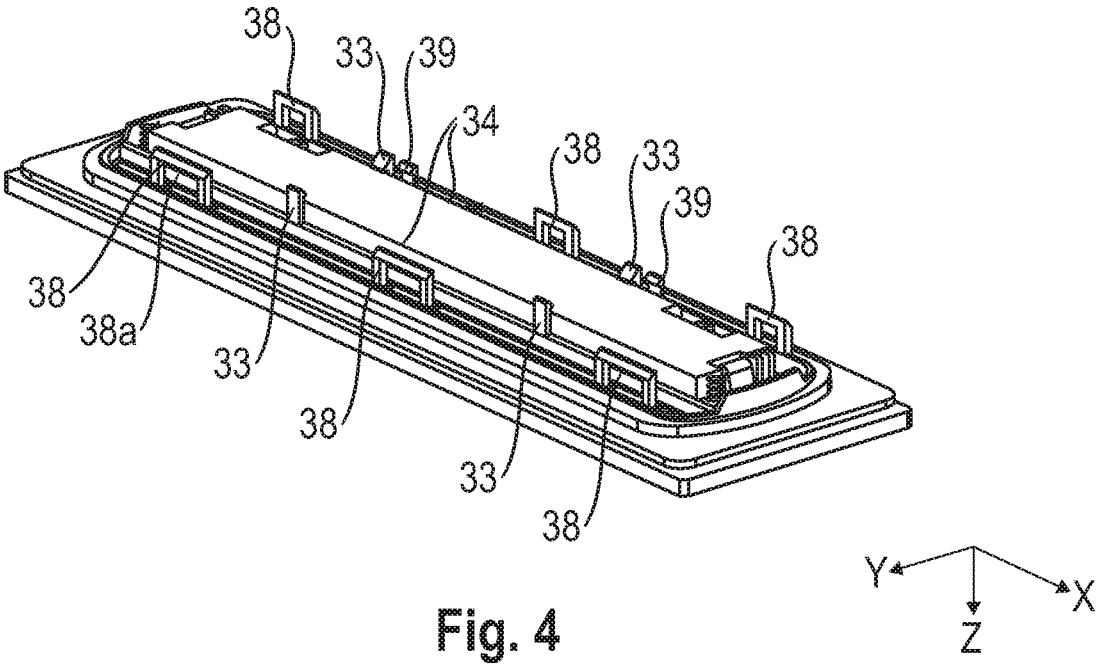
FIG. 4 is a rear-perspective view of the display and/or control unit with an assembled electronic display and/or control.

The carrier frame 16 has first snap-on elements 33 in the form of snap-on hooks which are used to fasten the electronic display and/or control 21. In this exemplary embodiment, two first snap-on elements 33 are disposed on two opposing sides of the cutout 18 in each instance. As can be seen in particular in FIG. 4, the first snap-on elements 33 engage behind snap-on edges 34 of the housing 22. The snap-on edges 34 are formed by the edges of the housing 22 itself. The first snap-on elements 33 are embodied so that the electronic display and/or control 21 is detachably connected to the carrier frame 16 in a non-destructive manner. Catch tappets embodied on the first snap-on elements 33 are positioned so that the electronic display and/or control 21 is fixed with play in the height direction Z. The first snap-on elements 33 are disposed on guide sections 35. The first snap-on elements 33 and the guide sections 35 form guide surfaces 36 facing the electronic display and/or control 21, by using which the electronic display and/or control 21 is positioned in the depth direction Y.

The carrier frame 16 has a flange 37, to which the sealing element 20 is fastened, namely foamed, on the outside.

Three snap-on bridges 38 for fastening the display and/or control unit 11 in the receptacle 29 are provided on the carrier frame 16 on two opposing sides in each case. The snap-on bridges 38 each include outwardly directed catch tappets 38*a*.

The carrier frame 16 includes a wire flashing 39 formed by two holding claws. An overlength of the electrical wire 23 can be clamped below the holding claws and thus kept safe.

The snap-on bridges 38, the first snap-on elements 33, the wire flashing 39 and the electronic display and/or control 21 are disposed within the flange 37 and in particular within the sealing element 20 in a projection display parallel to the main extension direction of the plate 12.

Figure 5:
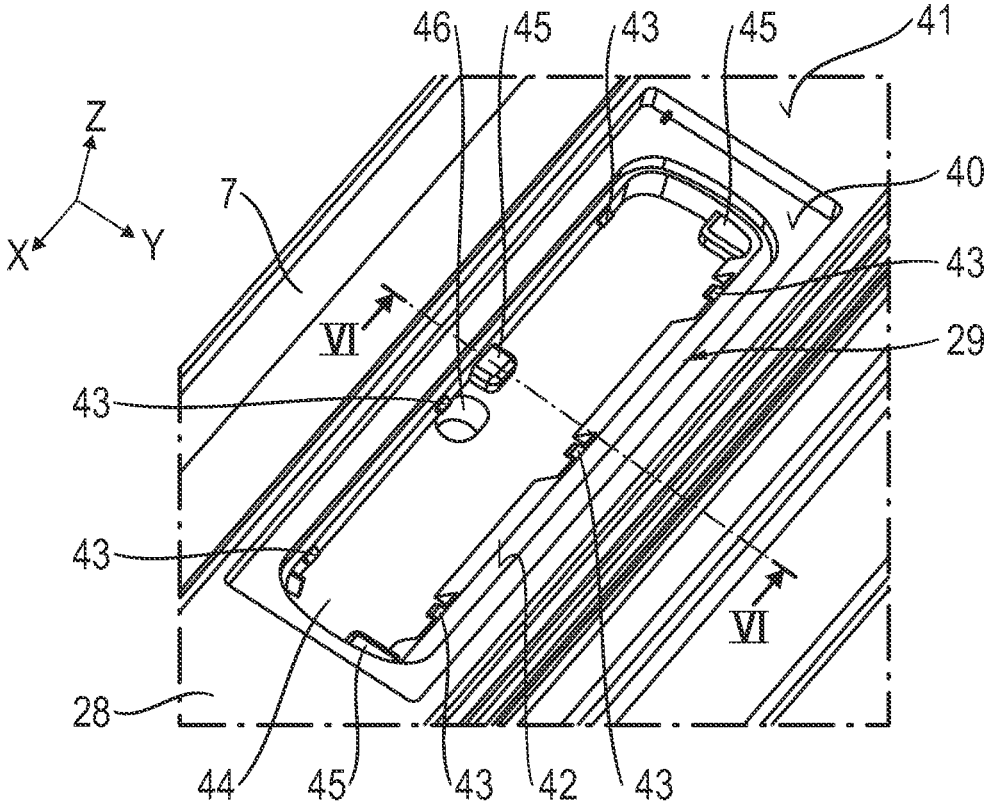
FIG. 5 is a fragmentary, perspective view of the drawer front without a display and/or control unit.

FIG. 5 shows a perspective representation of a cutout of the drawer front 9 without a display and/or control unit 11, in which the receptacle 29 is shown.

The rectangular receptacle 29 has a supporting surface 40 embodied to be circumferentially closed in this exemplary embodiment. The supporting surface 40 is embodied substantially parallel to a surface 41 of the terminating element 28 which encloses the receptacle 29. The supporting surface 40 serves, as in particular identified in FIG. 6, to provide an end stop for the carrier frame 16. In particular, the frame 19 of the carrier frame 16 and the supporting surface 40 overlap. When the display and/or control unit 11 is assembled, damage to the electronic display and/or control 21 can be avoided by using this end stop, for instance.

A sealing seat 42 is embodied in the height direction Z below the supporting surface 40. A defined contact surface can be provided for the sealing element 20 by using the sealing seat 42 (see also FIG. 6).

Second snap-on elements 43 in the form of catch tappets are embodied in the receptacle 29. The two snap-on elements 43 are disposed on two opposing sides of the receptacle 29.

Starting from a base 44 of the receptacle 29, projections 45 are provided which embody supporting surfaces for the spring elements 31.

A wire bushing 46 is disposed in the base 44. The wire bushing 46 has a pipe connection 47 which extends away from the plate 12 starting from the base 44 (see also FIG. 6).

Figure 6:
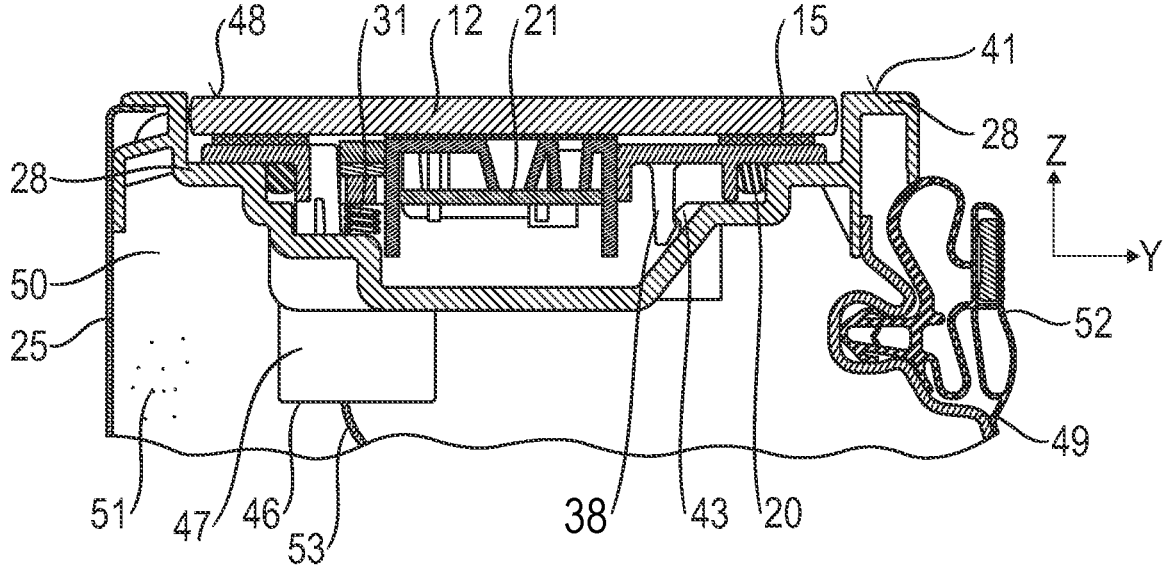
FIG. 6 is a cross-sectional view taken along the line VI-VI of FIG. 5 in the direction of the arrows.

FIG. 6 shows a section along the line VI-VI from FIG. 5, but with an inserted display and/or control unit 11.

The display and/or control unit 11 is shown in a state in which it is pressed downward by a force acting against the height direction Z (for instance during assembly). In this state an outer surface 48 of the plate 12 and the surface 41 enclosing the plate 12 are furthermore substantially flush. It is only when there is no force acting against the height direction Z on the display and/or control unit 11 that the spring elements 31 cause the display and/or control unit 11 to be pushed upward in the height direction X and the first snap-on bridges 38 with the second snap-on elements 43 (in particular catch tappets embodied on both elements) ensure an end position in the height direction Z. In this end position, the outer surface 48 is flush with the surface 41.

A rear wall 49 bounds a cavity 50 of the drawer front 9, inter alia together with the front wall 25 and the terminating element 28. The cavity 50 is filled with insulation material 51. The electrical wire 53 running in the cavity 50 is guided into the receptacle 29 by the wire bushing 46. A seal 52 with which the drawer front 9 is sealed relative to the body 2 is disposed on the rear wall 49.

LIST OF REFERENCE CHARACTERS

1 household refrigeration appliance
2 body
3, 4, 5, 6 closure element
7, 8 handle
9, 10 drawer front
11 display and/or control unit
12 plate
13 width
14 depth
15 adhesive bond
16 carrier frame
17 connection surface
18 cutout
19 frame
20 sealing element
21 electronic display and/or control
22 housing
22*a* electrical terminal
23 electrical wire
24 connector,
25 front wall
26, 27 narrow sides
28 terminating element
29 receptacle
30 spring band
30*a* adhesive surface
31 spring element
32 rear side
33 first snap-on element
34 snap-on edge
35 guide section
36 guide surface
37 flange
38 snap-on bridge
39 wire flashing
40 supporting surface

41 surface
42 sealing seat
43 second snap-on element
44 base
45 projection
46 wire bushing
47 pipe connection
48 outer surface
49 rear wall
50 cavity
51 insulation material
52 seal
53 electrical wire

The invention claimed is:

1. A household refrigeration appliance, comprising:

a body having a storage compartment disposed in said body;

a terminating element for closing said storage compartment, said terminating element having a receptacle with first snap on elements;

a display and/or control unit having an electronic display and/or control;

a cover for said display and/or control unit, said cover formed by a plate having a rear; and a carrier frame fastened to said rear of said plate, said carrier frame having second snap-on elements formed thereon for engaging said display and/or control and fixing said carrier frame to said display and/or control and defining an assembly, said carrier frame having third snap-on elements formed thereon for engaging said first snap on elements and fixing said assembly in said receptacle.

2. The household refrigeration appliance according to claim 1, wherein said plate is formed of glass.

3. The household refrigeration appliance according to claim 1, wherein said plate is non-detachably connected to said carrier frame.

4. The household refrigeration appliance according to claim 3, which further comprises an adhesive bond connecting said plate to said carrier frame.

5. The household refrigeration appliance according to claim 4, wherein said adhesive bond is a sealing adhesive bond.

6. The household refrigeration appliance according to claim 4, wherein said adhesive bond is formed by a closed porous adhesive tape.

7. The household refrigeration appliance according to claim 1, wherein said electronic display and/or control is detachably fastened to said carrier frame.

8. The household refrigeration appliance according to claim 1, wherein said second snap-on elements fix said electronic display and/or control and said carrier frame in a first direction and a second direction oriented at right angles to said first direction, and said electronic display and/or control and said carrier frame are mounted with play in a third direction oriented at right angles to said first direction and said second direction.

9. The household refrigeration appliance according to claim 1, wherein said plate has a rear side, and at least one spring element presses said electronic display and/or control against said rear side of said plate.

10. The household refrigeration appliance according to claim 1, wherein said display and/or control unit is detachably fastened at the household refrigeration appliance.

11. The household refrigeration appliance according to claim 1, which further comprises a seal disposed on said carrier frame.

12. The household refrigeration appliance according to claim 11, wherein said seal has a narrow side, and said display and/or control unit is fastened to said narrow side.

13. The household refrigeration appliance according to claim 12, which further comprises:

a terminating wall at least partially forming said narrow side;

said receptacle formed in one piece in said terminating element.

14. The household refrigeration appliance according to claim 13, wherein said terminating element completely forms said narrow side.

15. The household refrigeration appliance according to claim 1, wherein:

said plate defines a main extension plane and a projection plane parallel to said main extension plane;

a rectangle encloses said plate and has a surface; and a rectangle enclosing said carrier frame in said projection plane corresponds to at least 75% of said surface of said rectangle enclosing said plate.

16. The household refrigeration appliance according to claim 15, wherein said rectangle enclosing said carrier frame in said projection plane corresponds to at least 80% of said surface of said rectangle enclosing said plate.

17. The household refrigeration appliance according to claim 15, wherein said rectangle enclosing said carrier frame in said projection plane corresponds to at least 90% of said surface of said rectangle enclosing said plate.

* * * * *